US012031238B2

(12) United States Patent
Abati

(10) Patent No.: US 12,031,238 B2
(45) Date of Patent: Jul. 9, 2024

(54) COSMETIC FABRIC

(71) Applicant: HUMANWELLNESS SA, Lugano (CH)

(72) Inventor: Andrea Abati, Capolago (CH)

(73) Assignee: HUMANWELLNESS SA, Lugano (CH)

( * ) Notice: Subject to any disclaimer, the term of this patent is extended or adjusted under 35 U.S.C. 154(b) by 572 days.

(21) Appl. No.: 16/333,750

(22) PCT Filed: Sep. 15, 2017

(86) PCT No.: PCT/IB2017/055601
§ 371 (c)(1),
(2) Date: Mar. 15, 2019

(87) PCT Pub. No.: WO2018/051285
PCT Pub. Date: Mar. 22, 2018

(65) Prior Publication Data

US 2019/0357602 A1 Nov. 28, 2019

(30) Foreign Application Priority Data

Sep. 19, 2016 (IT) ..... 102016000093856

(51) Int. Cl.
*D01F 1/10* (2006.01)
*A41D 31/18* (2019.01)
(Continued)

(52) U.S. Cl.
CPC ..... *D01F 1/10* (2013.01); *A41D 31/18* (2019.02); *D01F 1/106* (2013.01); *D01F 6/60* (2013.01);
(Continued)

(58) Field of Classification Search
CPC ..... D01F 6/00–96; D01F 1/00–106; D01D 5/00–426; D01D 1/00–106;
(Continued)

(56) References Cited

U.S. PATENT DOCUMENTS 6,528,162 B1 * 3/2003 Teranishi ..... D01F 1/10 264/172.1
7,105,058 B1 * 9/2006 Sinyagin ..... D04H 3/02 118/713
(Continued)

FOREIGN PATENT DOCUMENTS

CN 201957775 9/2011
EP 1564242 8/2005
(Continued)

OTHER PUBLICATIONS

Office Action issued on Oct. 19, 2020 by the European Patent Office for corresponding EP application No. 17780894.6.
(Continued)

*Primary Examiner* — Marla D McConnell
*Assistant Examiner* — Kevin Worrell

(57) ABSTRACT

Garment (100) comprising a fabric (10) formed by at least one first yarn (1) and at least one second yarn (2), wherein said first yarn (1) comprises granules (1*a*) of material adapted to reflect, and/or emit and/or absorb infrared radiation, and wherein said second yarn (2) comprises microcapsules (2*a*) containing at least one cosmetic compound.

13 Claims, 4 Drawing Sheets

(51) Int. Cl.

| | |
|---|---|
| ***D01F 6/60*** | (2006.01) |
| ***D01F 6/62*** | (2006.01) |
| ***D02G 3/04*** | (2006.01) |
| ***D04B 1/16*** | (2006.01) |

(52) U.S. Cl.
CPC ..... *D01F 6/62* (2013.01); *D02G 3/04* (2013.01); *D04B 1/16* (2013.01); *D10B 2403/0114* (2013.01); *D10B 2403/0243* (2013.01); *D10B 2501/02* (2013.01)

(58) Field of Classification Search
CPC ..... D01D 7/00–02; D01D 10/00–06; D01D 11/06; B29C 48/05; B29D 99/0078; B29L 2031/731; B29L 442/202; Y10T 442/3171; Y10T 442/642
USPC ..... 442/365; 264/172.11–172.15, 264/172.17–172.18, 177.13–177.15
See application file for complete search history.

(56) References Cited

U.S. PATENT DOCUMENTS

| | | | | |
|---|---|---|---|---|
| 2002/0168488 | A1* | 11/2002 | Gladfelter | B32B 27/322 428/36.1 |
| 2008/0128941 | A1* | 6/2008 | Lopez | C08K 7/02 264/172.11 |
| 2010/0227522 | A1 | 9/2010 | Chen et al. | |
| 2013/0167305 | A1* | 7/2013 | Weisman | B32B 5/14 8/137 |
| 2013/0273365 | A1* | 10/2013 | Hartmann | D01F 1/10 428/372 |
| 2015/0223411 | A1* | 8/2015 | Toye | A01G 13/0268 442/49 |

FOREIGN PATENT DOCUMENTS

| | | |
|---|---|---|
| EP | 1923423 | 5/2008 |
| EP | 2208816 | 7/2010 |
| EP | 2392712 | 12/2011 |
| EP | 3031431 | 6/2016 |
| KR | 20050004361 | 1/2005 |
| KR | 20120078238 | 7/2012 |
| WO | 2009124367 | 10/2009 |
| WO | 2012109474 | 8/2012 |
| WO | 2017173487 | 10/2017 |

OTHER PUBLICATIONS

International Search Report and written opinion issued on Nov. 21, 2017 for PCT/IB2017/055601.

* cited by examiner

COSMETIC FABRIC

FIELD OF THE INVENTION

The present invention relates to the field of fabrics, more particularly fabrics for garments which may have beneficial effects on the wearer.

Known Background Art Fabrics whose yarn is able to heat the wearer skin by reflecting or emitting radiation in the infrared region are known. The document US2013/0183359 describes, for example, a polymeric yarn provided with additives or fillers having properties of emitting and/or absorbing radiation in the infrared region. Such additives or fillers, for example, can stimulate blood microcirculation and cell metabolism and may be selected from among oxides, sulfates, carbonates, phosphates and silicates, or silicone-containing organic compounds.

WO2009124367A2 describes a garment comprising a tissue impregnated with bioceramic microparticles. Particles are applied to the fabric by means of a bath. These particles allow blood microcirculation to be activated.

Garments, known as "cosmetic textiles", provided with active ingredients of cosmetic or pharmacological nature, are also known. Such garments gradually release the mentioned active ingredients and provide, for example, a pain-killing, anesthetic or relaxing effect, and/or improve cellulite blemishes.

EP2208816A1 describes fabric comprising an elastic yarn and a non-elastic yarn. The fabric is made so as to have a face intended to come into contact with the skin and mainly containing the elastic yarn. Optionally, non-elastic yarn may comprise microcapsules containing a cosmetic product.

Generally, in order to make "cosmetic textiles" garments, it is known to immerse the garment in a solution containing the active ingredients above mentioned. However, cosmetic properties of the garments obtained through this process are subject to a rapid decrease. In fact, the garment quickly loses the mentioned active ingredients, in particular as a result of one or few washings. Similarly, even fabrics (such as described in WO2009124367A2) lose their effectiveness after a number of washings and/or due to wear caused by rubbing.

SUMMARY OF THE INVENTION

Object of the present invention is to provide a fabric (and a garment at least partially made of such fabric) able to provide effective and long-lasting cosmetic treatment.

Another object of the present invention is to provide a fabric (and a garment at least partially made of such fabric) made of at least two yarns synergistically operating to improve microcirculation, one of them locally increasing the temperature in order to activate and/or increase the release of cosmetic substances by the second one.

The present invention achieves these and other objects by means of a fabric and a garment according to the independent claims.

Preferred aspects are set forth in dependent claims.

According to an aspect of the present invention, a garment comprises a fabric formed by at least one first yarn and at least one second yarn, wherein the first yarn comprises granules of material adapted to reflect, and/or emit and/or absorb infrared radiation, and wherein the second yarn comprises microcapsules containing at least one cosmetic compound.

Material adapted to reflect, and/or emit and/or absorb infrared radiation means a material reflecting (adapted to reflect), and/or emitting (adapted to emit), and/or absorbing (adapted to absorb) electromagnetic waves in the infrared band.

Thus, the garment made according to the present invention is able to simultaneously provide a plurality of cosmetic treatments, which are beneficial for the wearer.

In particular, heat emitted by the human body in the form of infrared rays is substantially reflected by the first yarn. Infrared rays are emitted by the first yarn and positively affect the action of the cosmetic compound, allowing the latter to better operate. For example, the Applicant observed that the action of infrared rays reflected by the first yarn contributes to the penetration of the cosmetic compound onto the skin of the user. In this way, even after using the garment for only a few days, cosmetic treatment is effective. Moreover, according to particular aspect, the capsules are designed to release the cosmetic compound only when a given threshold temperature is exceeded. Therefore the action of the first yarn with the emission and/or absorption of the infrared rays preferably contributes to open the microcapsules.

In order to increase the amount of cosmetic compound released, as well as to increase the surface through which the garment absorbs and/or emits infrared radiation, it is preferable that on one side of the fabric an amount of second yarn is greater than the amount of first yarn. On the contrary, on the opposite side there is the reverse condition. The side mainly having the second yarn, when in use, is the one intended to be in contact with the user's skin.

Preferably, the inner side of the garment, when in use and facing the user, has a negligible amount of the first yarn with respect to the amount of the second yarn.

Preferably, the outer side of the garment, when in use and facing outward, has a negligible amount of the second yarn with respect to the amount of the first yarn. More preferably, at least part of the garment has a side substantially having only the second yarn, and a side (the opposite side) substantially having only the first yarn.

According to an aspect of the present invention, in order to have a side with a greater amount of second yarn with respect to the first one, the fabric is plated. The term "plating" refers to the technique (used in hosiery and seamless) of knit-stitch formation with two yarns at the same time in the same needle.

According to an aspect of the present invention, the material adapted to reflect, and/or emit and/or absorb infrared radiation comprises bioceramic material. Preferably, the bioceramic material comprises at least one element selected among titanium (preferably titanium dioxide), magnesium, zinc, silicon, aluminum. More preferably, the bioceramic material comprises all the above mentioned elements.

According to a further aspect, the granules of the material adapted to reflect and/or emit and/or absorb infrared radiation are inserted inside the first yarn. Similarly, the microcapsules are inserted inside the second yarn. In particular, most of said granules of material adapted to reflect and/or emit and/or absorb infrared radiation is inserted inside the first yarn, a negligible part (for example due to production tolerances and/or defects) may still be present on the surface of the first yarn, still falling within the protection scope of the present invention. Generally, at least part of the granules of material adapted to reflect and/or emit and/or absorb infrared radiation (preferably most of them) is inserted inside the first yarn.

In order to insert the granules of material adapted to reflect and/or emit and/or absorb infrared radiation inside the first yarn, polymer granules, known in the art as "masterbatches", are initially prepared and filled with the above mentioned granules of material adapted to reflect and/or emit and/or absorb infrared radiation. The filled polymer granules are melted together with further polymeric granules and the molten material is spun. The same process is carried out to produce the second yarn, where the "masterbatch" is prepared by filling the granules of polymeric material with the microcapsules containing at least one cosmetic compound.

Thus, granules and capsules can not be easily removed from the garment, for example by abrasion or washing of the garment. In particular, most microcapsules are inserted inside the second yarn, while a negligible part of them can still be on the surface of the first yarn (for example due to production tolerances and/or defects), still remaining within the protection scope of the present invention. In general, at least part of the microcapsules (preferably most of them) are inserted inside the second yarn.

According to a further aspect, the microcapsules contain at least one compound selected among caffeine, Aloe vera, vitamin A, vitamin E. More preferably, the microcapsules comprise all of the aforementioned compounds.

Preferably, the microcapsules are in said second yarn in a weight percent between 0.5 and 1%.

As mentioned, the microcapsules are preferably designed so as to release their own content at a temperature higher than or equal to a threshold temperature; preferably such threshold temperature is equal to about 35° C.

According to an aspect of the present invention, the microcapsules have a coat preferably composed of silicates, and have a plurality of holes covered by a membrane designed to allow said cosmetic compound to pass through said holes at a temperature higher than said threshold temperature. Typically, the membrane changes its permeability so as to selectively allow or prevent the passage of the cosmetic compound through the capsule holes.

According to a further aspect, the first yarn comprises polyamide or polyester fibers. On the contrary, the second yarn preferably comprises polyamide fibers.

An aspect of the present invention further relates to a fabric comprising at least one first yarn and at least one second yarn, wherein the first yarn comprises granules of material adapted to reflect, and/or emit and/or absorb infrared radiation, and wherein the second yarn comprises microcapsules containing at least one cosmetic compound.

BRIEF DESCRIPTION OF THE DRAWINGS

Hereinafter, referring to the appended figures, exemplary and non-limiting embodiments of the present invention will be described, wherein.

EMBODIMENTS OF THE INVENTION

Figures 1A, 1B:
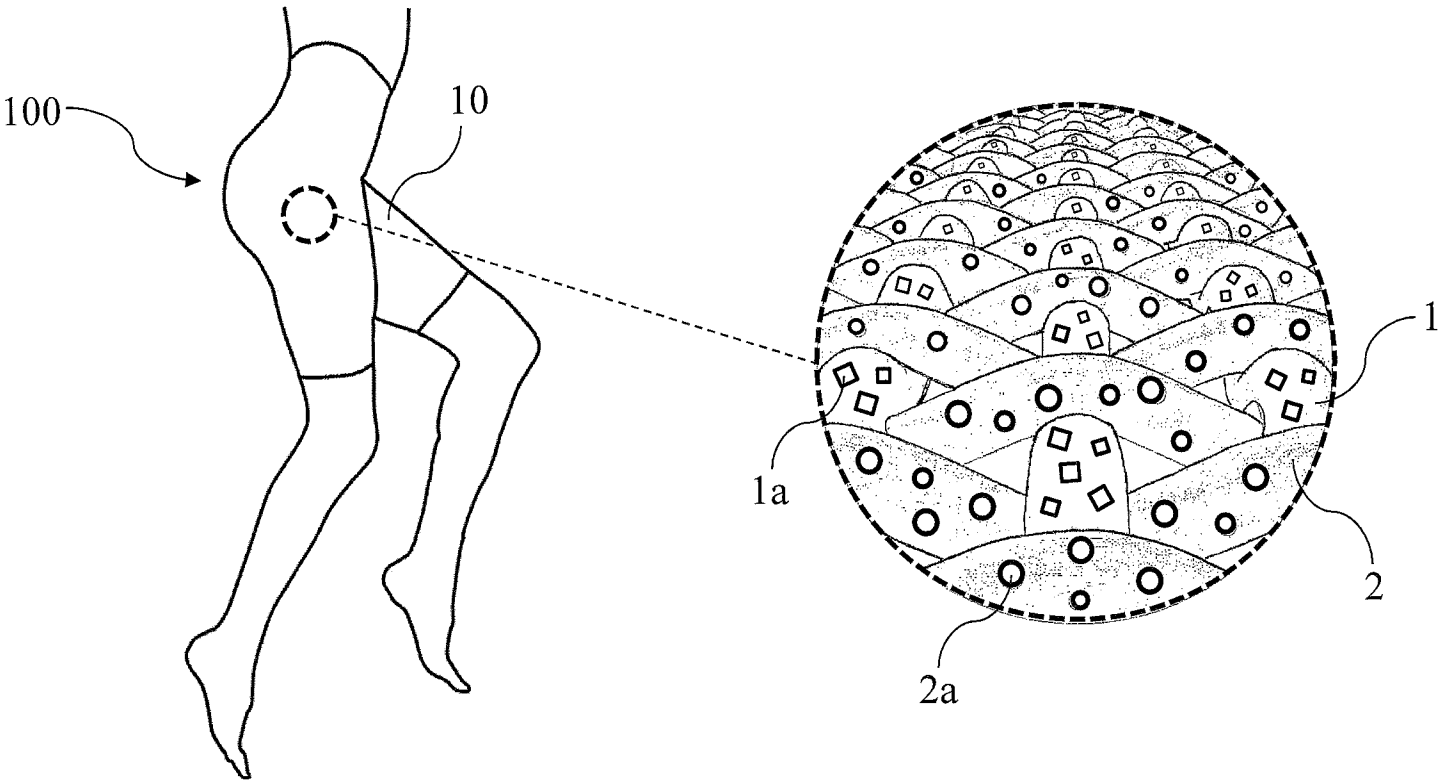
FIG. 1A is a perspective view showing a particular embodiment of a garment according to the present invention.
FIG. 1B symbolically shows a magnification of a portion of the garment of FIG. 1A in which there is a particular embodiment of the fabric according to the present invention.

Referring to FIGS. 1A and 1B, a garment 100 comprises a fabric 10 formed by a first yarn 1 and a second yarn 2.

The first yarn 1 comprises granules or microcrystals 1*a* of material adapted to reflect, and/or emit and/or absorb infrared radiation. Typically, these materials comprise bioceramic materials and comprise at least one element selected among titanium (preferably titanium dioxide), magnesium, zinc, silicon, aluminum. However, other materials adapted to carry out such a function are known in the art and may be used with the present invention.

A preferred embodiment provides that 1 kg of first yarn contains an amount of magnesium between 1 mg and 5 mg, an amount of zinc between 6 mg and 10 mg, an amount of aluminum between 80 mg and 114 mg, an amount of silicon between 157 mg and 257 mg, and an amount of titanium between 1860 mg and 2260 mg. More preferably, the first yarn comprises an amount of bioceramic material whose composition is measured out so that in 1 kg of first yarn 1 there is an amount of magnesium substantially equal to 3 mg, an amount of zinc substantially equal to 8 mg, an amount of aluminum substantially equal to 110 mg, an amount of silicon substantially equal to 207 mg and an amount of titanium substantially equal to 2060 mg.

Typically, the first yarn 1 is made of polyamide or polyester. Preferably, the dimensions of such particles, granules or microcrystals 1*a* are between 0.5 μm and 1 μm. Moreover, such granules or microcrystals 1*a* are generally in the first yarn in a weight percent between 4% and 5%.

Microcrystals (or granules or particles) have properties of emitting radiations in the infrared region in a wavelength range from 2 μm to 20 μm (FIR).

The second yarn 2 comprises microcapsules 2*a* and is typically made of polyamide. Preferably, the second yarn has thread count of 44/34 dtex, although yarns of different sizes may be used. Generally, the second yarn is weaved with another elastomeric yarn, preferably having thread count of 44/1 dtex, so as to provide the fabric with the required elasticity.

A cosmetic compound, typically including at least one of caffeine, Aloe vera, vitamin A, vitamin E, is contained inside the microcapsules 2*a*.

A preferred embodiment may provide that the cosmetic compound contained inside the microcapsules is a composition comprising castor oil, zeolite, aloe barbadensis leaf juice, oleic acid, polyhydroxystearic acid, silica, retinyl palmitate, tocopheryl acetate, tocopherol, sodium benzoate, potassium sorbate, caffeine. An example of a cosmetic product is shown in the table below.

| INCI NAME | % W/W | CAS NUMBER |
|---|---|---|
| *RICINUS COMMUNIS* (CASTOR) SEED OIL | 40.100 | 8001-79-4 |
| ZEOLITE | 40.100 | 1318-02-1 |
| *ALOE BARBADENSIS* LEAF JUICE | 4.250 | 85507-69-3 |
| OLEIC ACID | 4.250 | 112-80-1 |
| POLYHYDROXYSTEARIC ACID | 4.250 | 27924-99-8 |
| SILICA | 4.250 | 7631-86-9 |
| RETINYL PALMITATE | 0.800 | 79-81-2 |
| TOCOPHERYL ACETATE | 0.400 | 7695-91-2 |
| TOCOPHEROL | 0.400 | 10191-41-0 |
| SODIUM BENZOATE | 0.400 | 532-32-1 |
| POTASSIUM SORBATE | 0.400 | 24634-61-5 |
| CAFFEINE | 0.400 | 58-08-2 |

Figures 2A, 2B:
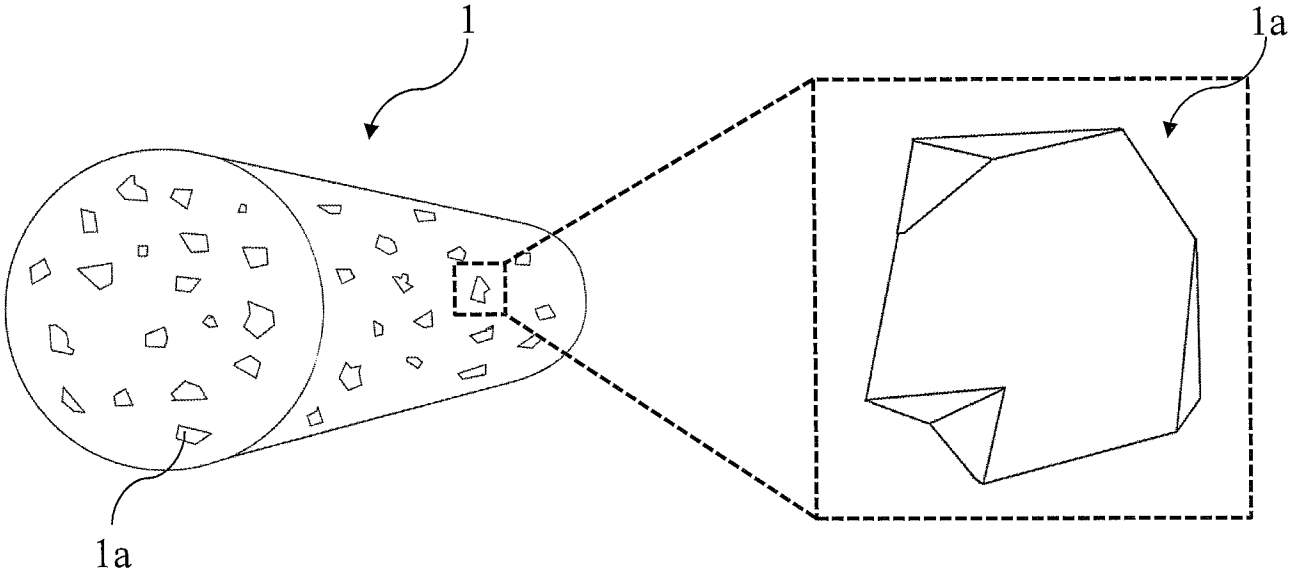
FIG. 2A is a perspective view symbolically showing the first yarn of the fabric or garment according to a particular embodiment of the present invention.
FIG. 2B symbolically shows a magnification of a portion of the yarn of FIG. 2A
Figures 3A, 3B:
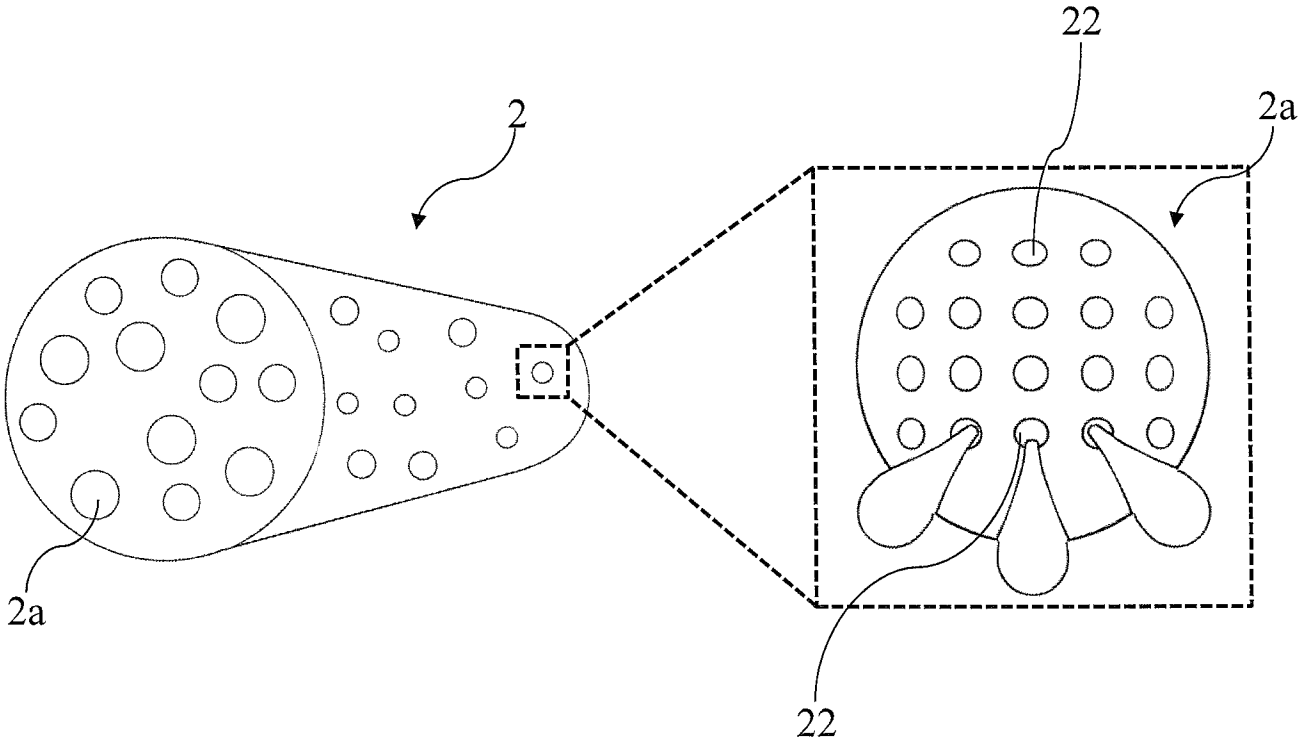
FIG. 3A is a perspective view symbolically showing the second yarn of the fabric or garment according to a particular embodiment of the present invention.
FIG. 3B symbolically shows a magnification of a portion of the yarn of FIG. 3A.

Referring to FIGS. 2A, 2B, at least part of the granules 1*a* of material adapted to reflect and/or emit and/or absorb infrared radiation is inserted inside the first yarn 1. Similarly, as shown in FIGS. 3A and 3B, at least part of the microcapsules 2*a* are arranged inside the second yarn 2.

A possible solution to obtain the first yarn is the following one. Firstly, granules ("masterbatch") are prepared, filled with granules 1*a* of material adapted to reflect and/or emit and/or absorb infrared radiation. Preferably, the masterbatch is polyamide-based, or in any case based on the polymer the first yarn 1 is mainly composed of.

Typically, the masterbatch is formed by adding to a molten polymer (e.g., polyamide) granules 1*a* of material adapted to reflect and/or emit and/or absorb infrared radiation, and subsequently cooling the material thus obtained.

Such granules are mixed to a polymeric material (typically polyamide, as above mentioned), and the resulting compound is melted and extruded for the spinning.

Therefore, the material adapted to reflect and/or emit and/or absorb infrared radiation can be substantially uniformly dispersed inside the first yarn 1.

Similarly, a possible solution to obtain the second yarn is the following one. Firstly, granules ("masterbatch") filled with microcapsules, are prepared. Preferably, the masterbatch is polyamide-based, or in any case based on the polymer the second yarn 2 is mainly composed of.

Typically, the masterbatch is formed by adding the microcapsules to a molten polymer (e.g., polyamide), and subsequently cooling the material thus obtained.

Such granules are mixed to a polymeric material (typically polyamide, as above mentioned), and the resulting compound is melted and extruded for the spinning. Therefore the microcapsules 2*a* can be substantially uniformly dispersed inside the second yarn 2.

Preferably, the microcapsules 2*a* are designed to release their own content (or anyway part of their own content) only when a given threshold temperature is exceeded, threshold temperature which, as said, is preferably equal to 35° C. (human body temperature).

In the embodiment shown in FIG. 3B, the microcapsules have holes 21 covered by membranes 22 which, as the threshold temperature (e.g., 35° C.) is exceeded, allow the cosmetic compound (symbolically denoted by drops coming out of the holes 21 of the microcapsule 2*a*) to pass through the holes 21 of the microcapsules. As above mentioned, the membranes 22 preferably change their permeability depending on the temperature and, as the threshold temperature is exceeded, allow the cosmetic compound to pass through the holes 21. Conversely, when the temperature of the microcapsule is lower than the threshold temperature, the membranes 22 hold back the cosmetic compound inside the microcapsules 2*a* themselves. The shell of the capsules is typically composed of silicates.

Preferably, as the threshold temperature is exceeded, the membranes 22 allow a slow release of the contents so that some time is needed to empty the microcapsules 2*a*. Typically, the microcapsules 22 are in the second yarn 2 in a weight percent between 0.5 and 1%.

The two yarns 1, 2 are preferably weaved so that the first yarn is mainly arranged on one side of the garment, while the second yarn 2 is mainly arranged on the opposite side. In particular, the fabric constituting the garment is such that the second yarn 2 is preferably arranged towards and in contact with the skin of a user wearing the garment itself, whereas the first yarn 1 is spaced from the skin of the user wearing the garment itself, precisely for the interposition of the second yarn 2, and is outwardly oriented.

Preferably, the inner side of the garment 100, when in use and facing the user, has a negligible amount of first yarn 1 with respect to the amount of the second yarn 2. More preferably, on the inner side of the garment 100, when in use and facing the user, there is only the second yarn.

Preferably, the outer side of the garment 100, when in use and facing the user, has a negligible amount of second yarn 2 with respect to the amount of the first yarn 1. More preferably, on the outer side of the garment 100, when in use and facing outward, there is only the first yarn 1.

Figure 4:
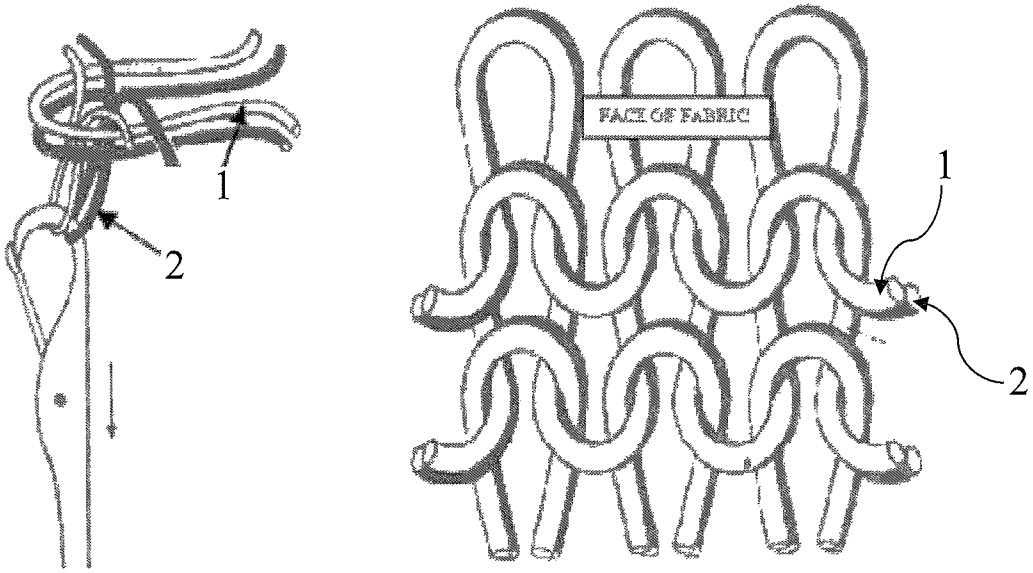
FIG. 4 schematically shows the plating technique.

As above mentioned, according to a preferred embodiment such condition is obtained, for example, by making a fabric according to the processing technique known as plating, schematically shown in FIG. 4.

It should be noted, therefore, that the magnification of FIG. 1B is only a schematic representation that, although allowing the two yarns 1, 2 to be displayed, does not necessarily represent the preferred embodiment.

In use, granules or microcrystals 1*a* reflect or absorb and emit infrared rays emitted by the body in the form of heat. The infrared rays penetrate the cutaneous and subcutaneous layers, thereby improving the microcirculation and drainage of the excess liquids.

The body heat and the action of the granules or microcrystals 1*a* activate the special membranes 22 covering the holes 21 that are on the microcapsules 2*a*, thereby allowing the components (active principles) contained therein to pass on the skin and slowly spread thereon, thus improving skin hydration and elasticity and counteracting cellulite blemishes.

Instrumental clinical tests proved that the continuous use of leggings made of a fabric according to the present invention leads on average to a significant reduction of waist, hips and thighs circumference, as well as an increase of skin elasticity and hydration.

In addition, a visible improvement in the appearance of the skin was found and a thermographic analysis revealed a reduction in cellulite.

The invention claimed is:

1. Garment (100) comprising a fabric (10) formed by plating at least one first yarn (1) with at least one second yarn (2) on the same needle, said garment (100) having an inner side and an outer side, wherein the inner side of the garment, when in use and facing a user, has a negligible amount of the first yarn with respect to the second yarn and the outer side of the garment has a negligible amount of the second yarn with respect to the amount of the first yarn, wherein said first yarn (1) comprises granules (1*a*) reflecting and/or emitting and/or absorbing infrared radiation emitted by a body of the user in the form of heat, at least part of said granules (1*a*) being inserted inside said first yarn (1), and said second yarn (2) comprises microcapsules (2*a*) containing at least one cosmetic compound, at least part of said microcapsules (2*a*) being inserted inside said second yarn (2), wherein said microcapsules and said at least one cosmetic compound synergistically operate such that said microcapsules (2*a*) release said at least one cosmetic compound when said infrared radiation reflected and/or emitted and/or absorbed by the first yarn causes a threshold temperature to be exceeded in said microcapsules (2*a*).

2. Garment (100) according to claim 1, wherein most of said granules (1*a*) are inserted inside said first yarn (1).

3. Garment (100) according to claim 1, wherein most of said microcapsules (2*a*) are inserted inside said second yarn (2).

4. Garment (100) according to claim 1, wherein said granules comprise bioceramic material comprising at least one element selected among magnesium, zinc, titanium, silicon and aluminium.

5. Garment (100) according to claim 4, wherein said first yarn comprises said bioceramic material so that in 1 kg of said first yarn there is an amount of magnesium between 1 mg and 5 mg, an amount of zinc between 6 mg and 10 mg, an amount of aluminum between 80 mg and 114 mg, an amount of silicon between 157 mg and 257 mg, and an amount of titanium between 1860 mg and 2260 mg.

6. Garment (100) according to claim 1, wherein said microcapsules (2*a*) contain a composition comprising caffeine, Aloe vera, vitamin A or vitamin E.

7. Garment (100) according to claim 6, wherein said microcapsules (2*a*) contain a composition comprising castor oil, zeolite, aloe barbadensis leaf juice, oleic acid, polyhydroxystearic acid, silica, retinyl palmitate, tocopheryl acetate, tocopherol, sodium benzoate, potassium sorbate or caffeine.

8. Garment (100) according to claim 1, wherein said microcapsules (2*a*) are in said second yarn (2) in weight percent between 0.5 and 1%.

9. Garment (100) according to claim 1, wherein said microcapsules (2*a*) are composed of silicates and have a plurality of holes (21) covered by a membrane (22) designed to allow said at least one cosmetic compound to pass through said holes (21) at a temperature higher than said threshold temperature.

10. Garment (100) according to claim 1, wherein said first yarn (1) comprises polyamide or polyester fibers.

11. Garment (100) according to claim 1, wherein said second yarn (2) comprises polyamide fibers.

12. Garment (100) according to claim 1, wherein said threshold temperature is about 35° C.

13. Garment (100) according to claim 1, wherein said granules (1*a*) have dimensions between 0.5 μm and 1 μm.

* * * * *